US008141307B2

(12) United States Patent
Hillman et al.

(10) Patent No.: US 8,141,307 B2
(45) **Date of Patent: *Mar. 27, 2012**

(54) HYBRID COMPOSITE BEAMS AND BEAM SYSTEMS

(75) Inventors: John R. Hillman, Wilmette, IL (US); Michael A. Zicko, Apex, NC (US)

(73) Assignee: HC Bridge Company, LLC, Wilmette, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/037,495

(22) Filed: Mar. 1, 2011

(65) Prior Publication Data

US 2011/0203195 A1 Aug. 25, 2011

Related U.S. Application Data

(63) Continuation of application No. 12/483,156, filed on Jun. 11, 2009, now Pat. No. 7,895,799, which is a continuation-in-part of application No. 11/332,794, filed on Jan. 13, 2006, now Pat. No. 7,562,499.

(51) Int. Cl.
*E04C 3/02* (2006.01)

(52) U.S. Cl. ..... 52/223.8; 52/607; 52/834

(58) Field of Classification Search ..... 52/80.1, 52/80.2, 81.1, 81.2, 233.8, 223.11, 223.12, 52/223.14, 220.1, 309, 334, 421.1, 649.2, 52/650.1, 724.2, 724.1, 737.1, 737.4, 738.1, 52/834, 839, FOR. 11–FOR. 115; 14/18, 14/20, 21, 22

See application file for complete search history.

(56) References Cited

U.S. PATENT DOCUMENTS

| | | | |
|---|---|---|---|
| 4,038,798 | A | 8/1977 | Sachs |
| 4,829,733 | A | 5/1989 | Long |
| 4,924,641 | A | 5/1990 | Gibbar, Jr. |
| 4,948,312 | A | 8/1990 | Jochum |
| 5,465,542 | A | 11/1995 | Terry |
| 5,671,572 | A | 9/1997 | Siller-France |
| 5,830,399 | A | 11/1998 | Keith et al. |
| 5,839,243 | A | 11/1998 | Martin |
| 5,921,046 | A | 7/1999 | Hammond, Jr. |
| 6,145,270 | A | 11/2000 | Hillman |
| 6,240,693 | B1 | 6/2001 | Komasara et al. |
| 6,308,478 | B1 | 10/2001 | Kintscher et al. |
| 7,275,347 | B2 | 10/2007 | Hayes |
| 7,287,358 | B2 | 10/2007 | Zambelli et al. |
| 2002/0178665 | A1 | 12/2002 | Campbell |
| 2003/0037497 | A1 | 2/2003 | Kirby |
| 2003/0182883 | A1 | 10/2003 | Won |

*Primary Examiner* — Jeanette E Chapman
*Assistant Examiner* — James Buckle, Jr.
(74) *Attorney, Agent, or Firm* — Ice Miller LLP

(57) ABSTRACT

The present application includes disclosure of various embodiments of composite construction beams and beam systems. In at least one exemplary embodiment of a composite construction beam of the present disclosure, the beam comprises an elongated shell having a length, a first relative end, and an interior volume, wherein the elongated shell defines a first aperture. An exemplary construction beam further comprises a first conduit within the interior volume of the elongated shell, the first conduit extending along a longitudinal direction of the beam and curving upward from the first relative end, and a second conduit within the interior volume of the elongated shell, the second conduit extending along at least a portion of the length of the elongated shell, wherein the first conduit and the second conduit are in communication with one another. In at least one embodiment, a construction beam of the present disclosure comprises a first flange positioned upon the elongated shell relative to the first aperture.

42 Claims, 15 Drawing Sheets

HYBRID COMPOSITE BEAMS AND BEAM SYSTEMS

PRIORITY

This continuation patent application is related to, and claims the priority benefit of, U.S. patent application Ser. No. 12/483,156, filed Jun. 11, 2009 and issuing as U.S. Pat. No. 7,895,799 on Mar. 1, 2011, which is related to, claims the priority benefit of, and is a continuation-in-part of, U.S. patent application Ser. No. 11/332,794, filed Jan. 13, 2006 and issuing as U.S. Pat. No. 7,562,499 on Jul. 21, 2009. The contents of each of these applications are hereby incorporated by reference in their entirety into this disclosure.

BACKGROUND

This disclosure of the present application relates generally to bridge structures and building structures designed for pedestrian and/or vehicular traffic, which may include, but is not limited to, commercial and industrial framed building construction and short to medium span bridges.

Many or most of the short-span bridge structures in the United States are constructed of a deck surface on top of a supporting structure, most commonly a framework of steel or prestressed concrete I-beams. For example, a conventional two-span bridge (a total span of 140 feet) could have a three-inch pavement-wearing surface on a seven-inch structural slab of reinforced concrete supported on top of a framing system consisting of five longitudinal thirty-six inch steel wide flange beams or five longitudinal forty-five inch type IV AASHTO prestressed concrete girders.

There is believed to be a significant need in the United States for a structural beam for use in the framework of a bridge that provides greater resistance to corrosion through the use of plastic (including fiber reinforced plastic), and that can be built not only at a competitive cost, but also with a reduction in the self weight of the structural members as it relates to transportation and erection costs.

It has been known that fabrication of structural elements from fiber reinforced plastics results in a structure that is less susceptible to deterioration stemming from exposure to corrosive environments. One type of structural framing member is currently manufactured using the pultrusion process. In this process, unidirectional fibers (typically glass) are pulled continuously through a metal die where they are encompassed by a multidirectional glass fabric and fused together with a thermosetting resin matrix such as vinyl ester.

Although the composite structural members offer enhanced corrosion resistance, it is well known that structural shapes utilizing glass fibers have a very low elastic modulus compared to steel and very high material costs relative to both concrete and steel. As a result, pultruded structural beams consisting entirely of fiber reinforced plastic may not be cost effective to design and fabricate to meet the serviceability requirements, i.e. live load deflection criteria, currently mandated in the design codes for buildings and bridges.

BRIEF SUMMARY

In at least one exemplary embodiment of a construction beam of the present disclosure, the beam comprises an elongated shell having a length, a first relative end, and an interior volume, wherein the elongated shell defining a first aperture. An exemplary construction beam further comprises a first conduit within the interior volume of the elongated shell, the first conduit having extending along a longitudinal direction of the beam and curving upward from the first relative end, and a second conduit within the interior volume of the elongated shell, the second conduit extending along at least a portion of the length of the elongated shell, wherein the first conduit and the second conduit are in communication with one another. In at least one embodiment, a construction beam of the present disclosure comprises a first flange positioned upon the elongated shell relative to the first aperture.

In various embodiments of a construction beam of the present disclosure, the first conduit and second conduit are sized and shaped to receive a compression reinforcement, whereby such a compression reinforcement may be positioned within at least part of the first conduit and at least part of the second conduit to contribute to the strength of the beam.

An exemplary construction beam of the present disclosure may further comprise at least one constraining member, the at least one constraining member positioned within the elongated shell external to the first conduit, wherein the at least one constraining member prohibits substantial deflection of the perimeter of the elongated shell. An exemplary constraining member may comprise a first lateral member having a first end and a second end, a first end member coupled to the first lateral member at the first end of the first lateral member, and a second end member coupled to the first lateral member at the second end of the first lateral member. In another embodiment, the constraining member further comprises a second lateral member positioned relative to the first lateral member, wherein the second lateral member is coupled at one end to the first end member and at another end to the second end member.

In yet another exemplary embodiment of a construction beam of the present application, the construction beam comprises a first flange comprising a first side and a second side, the first side of the first flange positioned relative to the elongated shell of the beam. In various embodiments, the first flange further comprises a structure positioned upon the second side of the first flange, and/or the first flange defines at least one aperture in communication with the second conduit. In another embodiment, the construction beam comprises a second flange positioned relative to the first flange and the elongated shell, the second flange sized and shaped to engage at least a portion of the elongated shell. In yet another embodiment, the construction beam further comprises a third flange positioned relative to the first flange and the elongated shell, the third flange sized and shaped to engage at least a portion of the elongated shell.

In an exemplary embodiment of a construction beam of the disclosure of the present application, the beam comprises an elongated shell having a length, a first relative end, and an interior volume, a first core material positioned within the elongated shell, wherein the first core material is tapered at one end, and a second core material positioned within the elongated shell relative to the first core material, wherein the first core material and the second core material do not engage one another, wherein the first core material and second core material define a first conduit extending at least a portion of length of the elongated shell and curving upward from the first relative end and further define a second conduit extending from the first conduit, and wherein the first conduit and second conduit are in communication with one another. In another embodiment, the construction beam further comprises a third core material, wherein the second core material and third core material further define the second conduit.

BRIEF DESCRIPTION OF THE DRAWINGS

Further advantages of the disclosure of the present application will become apparent upon reading the following detailed description in conjunction with the accompanying drawings, in which.

DETAILED DESCRIPTION

Figure 1:
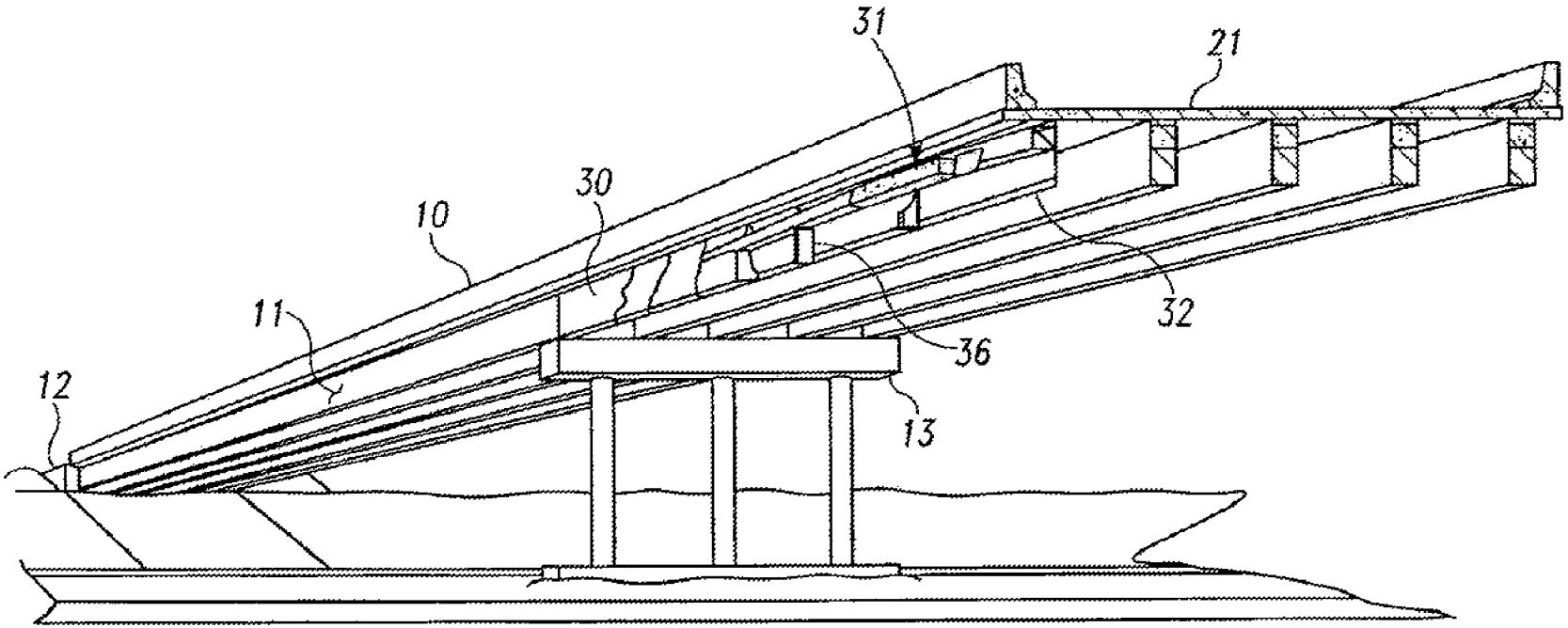
FIG. 1 shows a fragmentary perspective of a first embodiment of a bridge constructed using composite beams, according to the present disclosure.

Reference will now be made to the embodiments illustrated in the drawings and specific language will be used to describe the same. It will nevertheless be understood that no limitation of scope is intended by the description of these embodiments.

Figure 2:
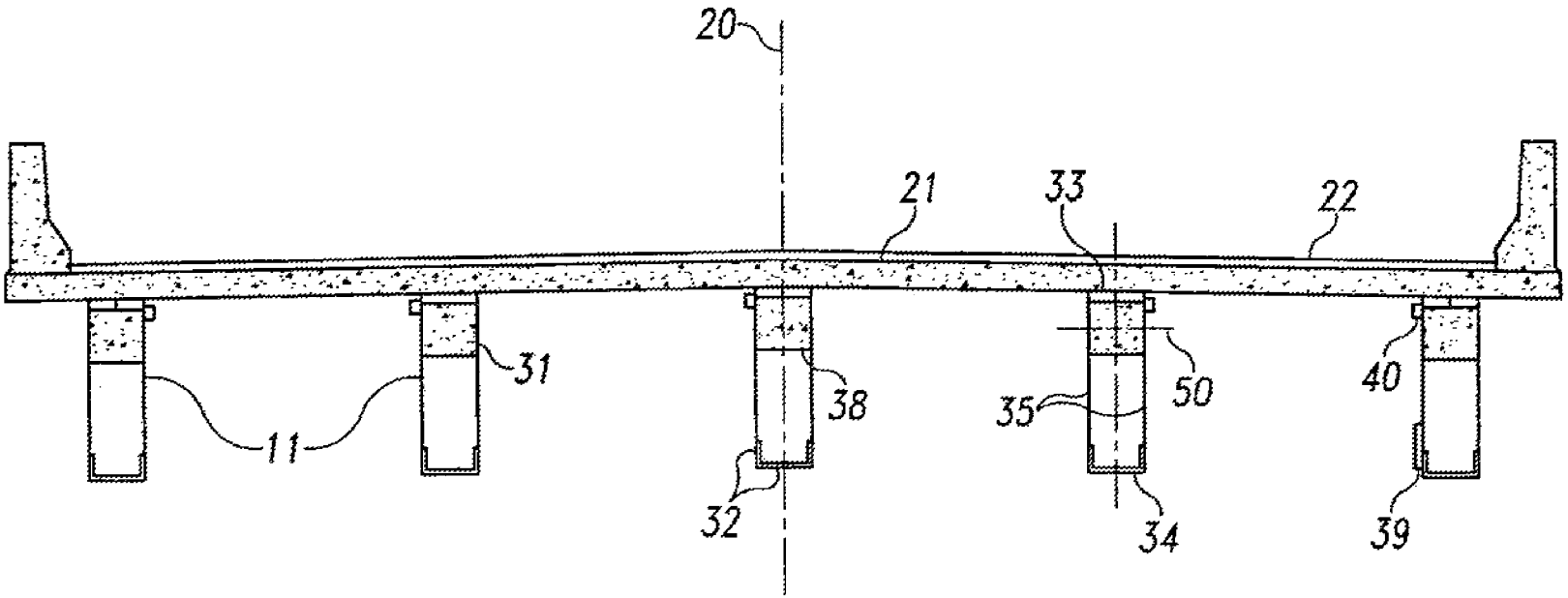
FIG. 2 shows a typical cross-sectional view of the bridge shown in FIG. 1, according to the present disclosure.

FIG. 1 shows an illustrative embodiment of a bridge 10. The illustrative bridge 10 shown in FIG. 1 is constructed using five rows of composite beams 11 spanning between bridge abutments 12 and over a central pier 13. These composite beams 11, in an exemplary embodiment, may be spaced at about seven-feet, six-inch intervals transversely in a symmetrical arrangement about a centerline 20 of the bridge 10 as shown in FIG. 2. The out-to-out width of the illustrative bridge 10 is shown as about thirty-five feet, but could be wider or narrower. For embodiments where the bridge 10 is wider or narrower, the number of composite beams 11, and the spacing of the composite beams 11 within the cross-section, may vary.

An illustrative bridge 10 comprises two spans of about seventy feet, and has two composite beams 11 per row. In an alternative embodiment, the illustrative bridge 10 could have more or fewer spans, and the spans could be longer or shorter. Each composite beam 11 in a row may simply be supported between an abutment 12 and the central pier 13. In another embodiment, two or more girders in one row could be made continuous over the supports. For bridges with more than two spans, the composite beams 11 could be supported between two adjacent piers 13. An exemplary deck surface may include deck slab 21 covered by, but not necessarily requiring, an overlying wearing pavement 22. In one embodiment, the deck slab 21 may be a reinforced concrete deck slab 21. The deck may be constructed out of materials other than reinforced concrete, such as, for example, a fiber reinforced plastic deck.

Figure 3:
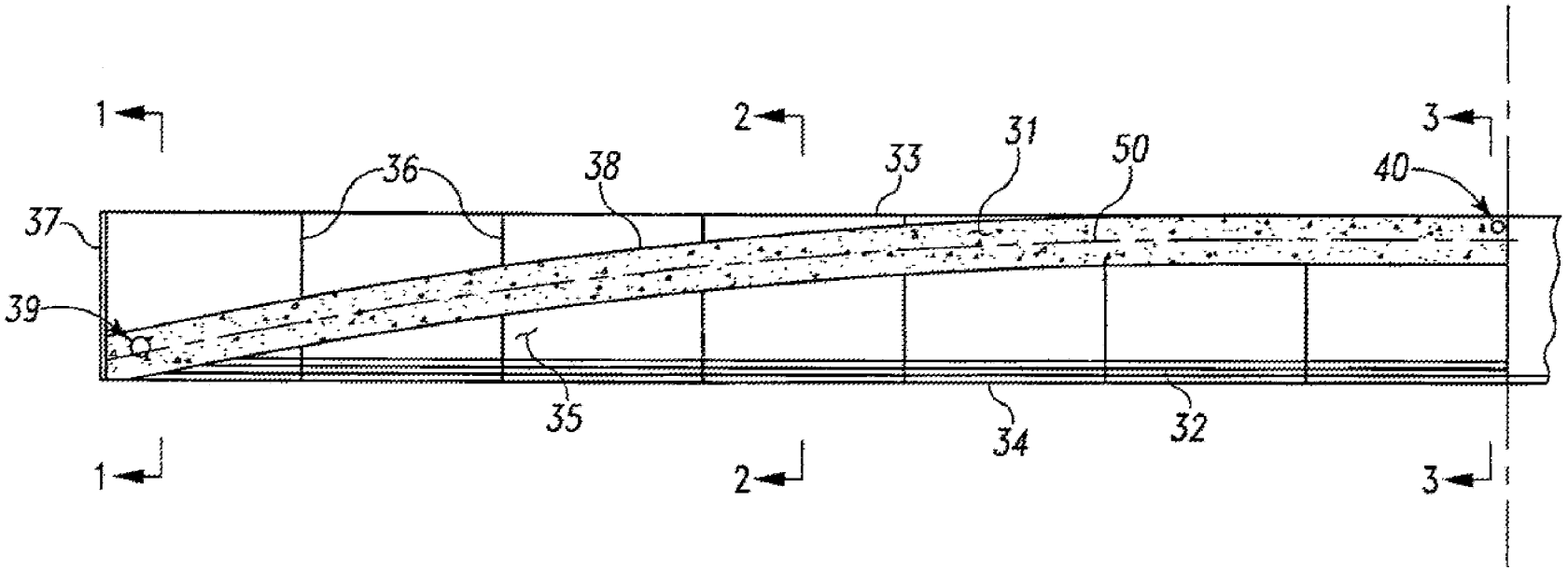
FIG. 3 shows a side view of a first embodiment of a composite beam of the bridge shown in FIG. 1, according to the present disclosure.

The composite beams 11 shown in FIG. 1 may include a beam shell 30, a compression reinforcement 31, and a tension reinforcement 32. In an exemplary embodiment, the composite beam 11 may also include a core material 44, as shown in FIGS. 4-7, and elsewhere. The composite beam 11 could be fabricated to a variety of widths and heights, and may also be constructed with the width and or height varying over the length of the composite beam 11. In the illustrative embodiment of the composite beam 11 shown in FIGS. 1-3, the composite beam 11 has a constant height of forty-seven inches and a constant width of sixteen inches. The height of the composite beams 11 in the bridge 10 illustrated in FIG. 1 may result in a span to depth ratio of approximately 18:1, but could be altered to provide different span to depth ratios while still remaining within the scope of the present disclosure and the attached claims.

The beam shell 30 of the composite beam 11 may be constructed of a vinyl ester resin reinforced by glass fibers optimally oriented to resist the anticipated forces in the composite beam 11. Composite beam 11 may also be constructed using other types of plastic resins, other types of resins, or other types of plastics. The beam shell 30 may include a top flange 33, a bottom flange 34, intermediate vertical stiffeners 36, and two end stiffeners 37. The beam shell 30 may also include a continuous conduit 38, an injection port 39, and vent ports 40 to be used for the compression reinforcement 31. The beam shell 30 may further include a shear transfer medium 35 which serves to transfer applied loads to the composite beam 11, and to transfer the shear forces between the compression reinforcement 31 and tension reinforcement 32.

In an exemplary embodiment, the shear transfer medium 35 comprises two vertical webs, but may also include one single or multiple webs, or truss members interconnecting the top flange 33, bottom flange 34, compression reinforcement 31 and tension reinforcement 32. All of the components of the beam shell 30 may be fabricated monolithically using a vacuum assisted resin transfer method, or using other manufacturing processes.

Figure 4:
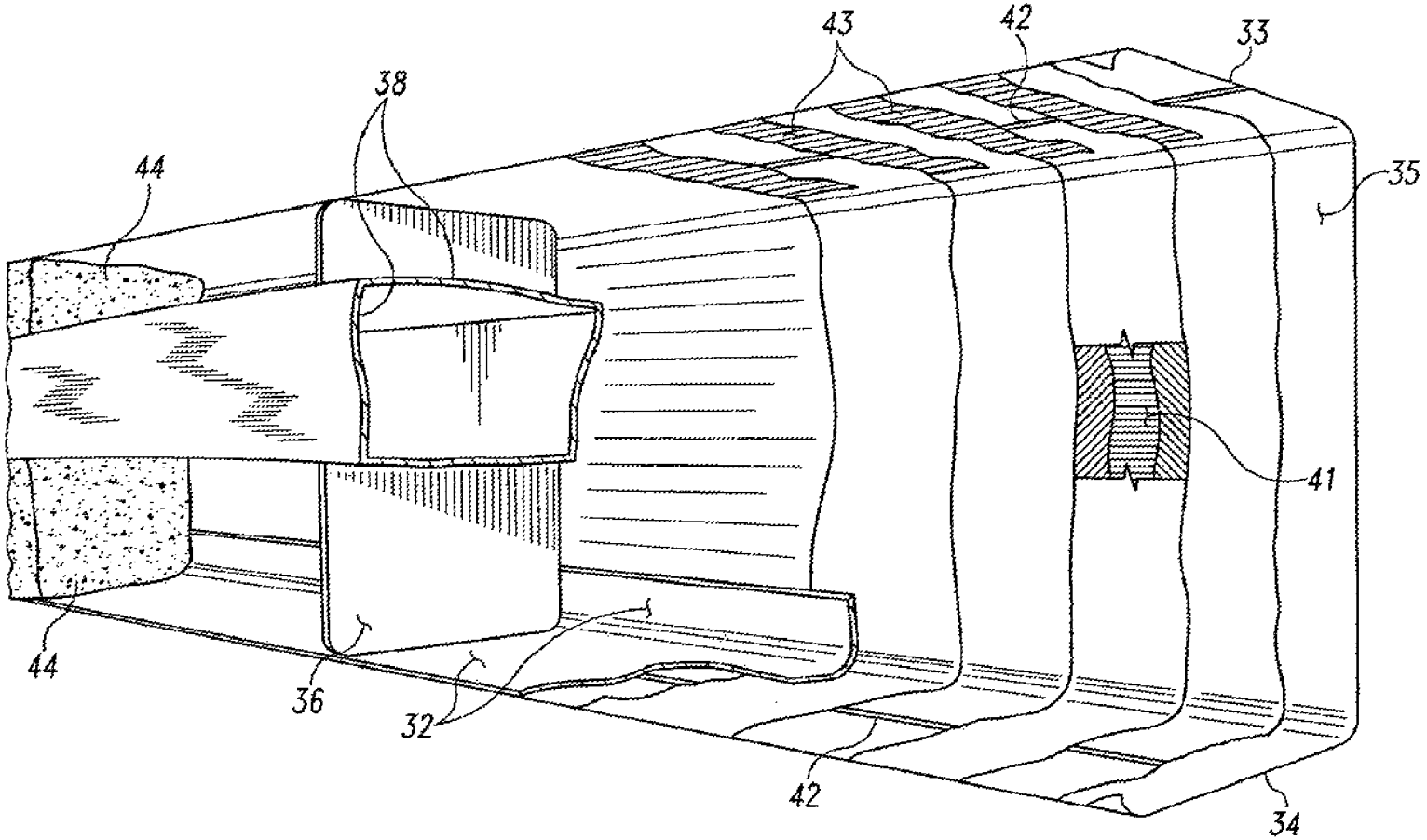
FIG. 4 shows a fragmentary perspective of a composite beam, according to the present disclosure.
Figure 7:
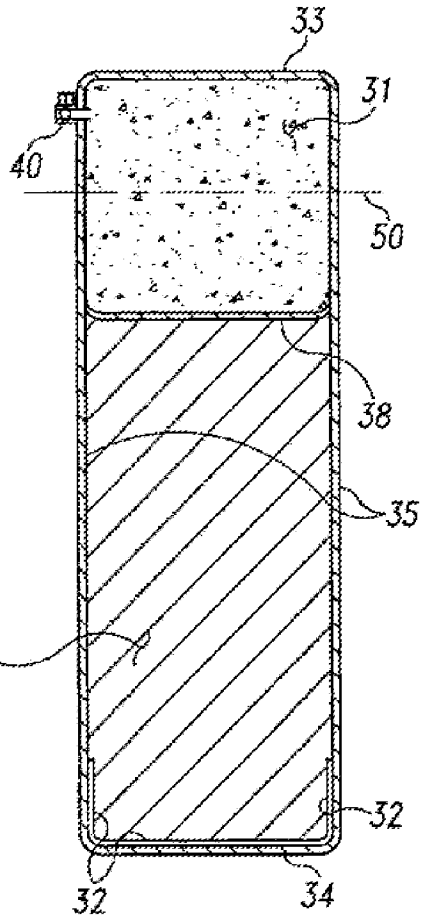
FIG. 7 shows a partial sectional view taken through line 3-3 of FIG. 3, according to the present disclosure.

As shown in FIG. 4, the core material 44 may be located above and below the continuous conduit 38, and/or may surround the continuous conduit 38. The core material 44 may be a low density foam, such as polyisocyanorate, polyurethane, polystyrene, some type of a starch such as wood or a synthetic or processed starch, or a fibrous material. The core material 44 may fill all or a portion of the void between the shell 30 and the continuous conduit 38. The core material 44 may act as an additional shear transfer element, or may serve to maintain the form of the composite beam 11 prior to resin injection and/or introduction of the compression reinforcement 31.

The shear transfer medium 35 of the beam shell 30 may be reinforced with six layers of fiberglass fabric 41 with a triaxial weave in which sixty-five percent of the fibers are oriented along the longitudinal axis of the composite beam 11 and the remaining thirty-five percent of the fibers are oriented with equal amounts in plus or minus forty-five degrees relative to the longitudinal axis of the composite beam 11. The fibers oriented at plus or minus forty-five degrees to the longitudinal axis may improve both the strength and stiffness as it relates to shear forces within the composite beam 11. The shear medium 35 may also be constructed with more or fewer layers of fiberglass reinforcing and with different dimensions, proportions or orientations of the fibers.

The layers of glass reinforcing fabric comprising the shear transfer medium of the beam shell 30 may extend around the perimeter of the cross section such that they also become the reinforcement for the top flange 33, bottom flange 34 and vertical end stiffener 37 of the beam shell 30. The perimeter of the beam shell 30 is a rectangle with the corners rounded on a radius, but could be constructed using a different shape. All longitudinal seams 42 of the fiberglass fabrics used in the beam shell 30 may be located within the top flanges 33 and bottom flanges 34 of the beam shell 30. The top flange 33 of the beam shell 30 may also contain four layers of unidirectional weave fiberglass fabric 43 located longitudinally between the layers of triaxial weave fabric 41 and which turn down at a ninety degree angle and help form the vertical end stiffener 37 of the beam shell 30.

Each beam shell 30 may also contain intermediate vertical stiffeners 36, again consisting of glass fiber reinforced plastic. The vertical stiffeners 36, are shown spaced at about five-feet longitudinal intervals along the beam shell 30 in FIG. 3, but could be spaced at different intervals. The dimensions of the vertical stiffeners 36 may be the same as the internal height and width of the beam shell 30. The reinforcing for the vertical stiffeners 36 may comprise three layers of the same triaxial weave glass fabric 41 used for the webs comprising the shear transfer medium 35, except with the sixty-five percent layer of fibers oriented along a vertical plane, perpendicular to the longitudinal axis of the composite beam 11. The illustrative vertical stiffeners 36 shown in FIG. 4 are about 0.126 inch thick, but could be constructed of different thicknesses. The vertical stiffeners 36 may also be fabricated using reinforcing fabrics with different proportions, orientations or composition.

Figure 5:
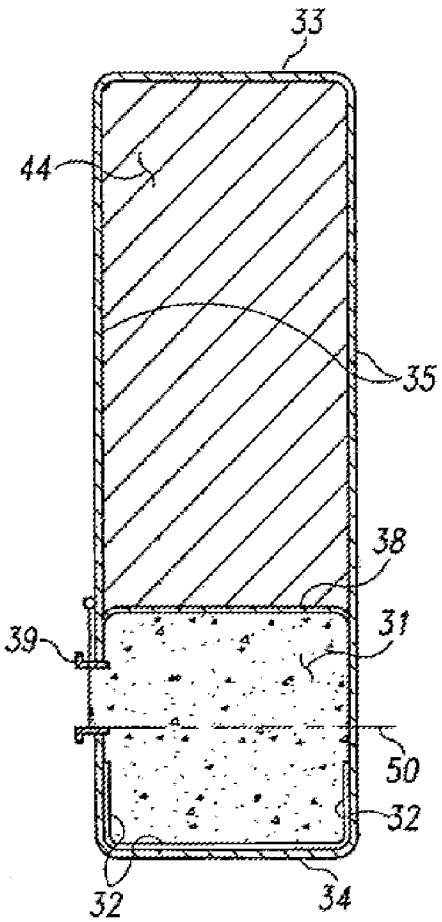
FIG. 5 shows a partial sectional view taken through line 1-1 of FIG. 3, according to the present disclosure.

The beam shell 30 may be fabricated with a conduit 38 which runs longitudinally and continuously between the ends of the composite beam 11 along a profile designed to accommodate the compression reinforcement 31, as described herein. The conduit 38 may comprise a continuous rectangular thin wall tube, or a rounded tube, or another shape of tube. The conduit 38 may, for example, be constructed of two layers of triaxial weave fiberglass fabric 41 as shown in FIG. 4. The conduit 38 passing through them interrupts the intermediate stiffeners 36 vertically, where the elevation of the interruption can be a function of the profile of the compression reinforcement 31. The conduit 38 may also contain an injection port 39 located along one web of the composite beam 11 as depicted in FIG. 5, to be used for the introduction of the compression reinforcement 31. Vent ports 40 are also located at the highest and lowest points along the profile of the conduit as shown in the exemplary embodiment of a composite beam 11 shown in FIG. 6. Again the conduit 38 could be constructed using reinforcing fabrics with different proportions, orientations or compositions.

Each of the composite beams 11 includes compression reinforcement 31. The compression reinforcement 31 may comprise portland cement concrete, portland cement grout, polymer cement concrete or polymer concrete. In an exemplary embodiment, the compression reinforcement 31 comprises portland cement concrete with a compressive strength of 6,000 pounds per square inch. The compression reinforcement 31 may be introduced into the conduit 38 within the beam shell 30 by pumping it through the injection port 39 located in the side of the conduit 38. The vent ports 40 may prevent air from being trapped within the conduit 38 during the placement of the compression reinforcement 31.

Figure 6:
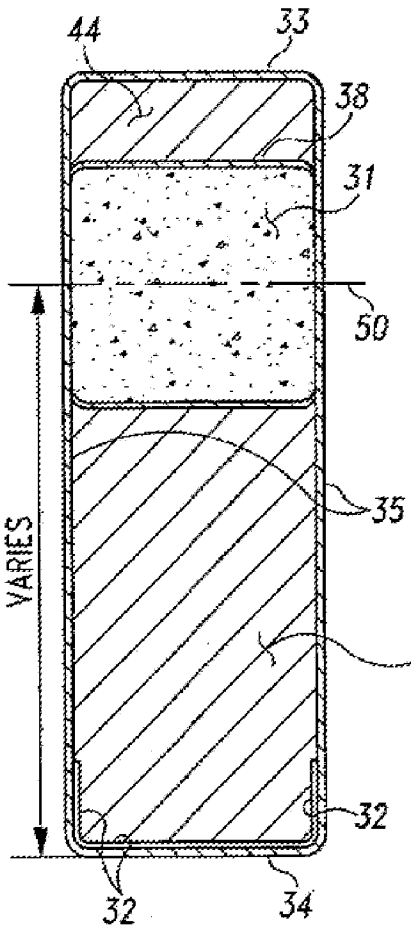
FIG. 6 shows a partial sectional view taken through line 2-2 of FIG. 3, according to the present disclosure.

The compression reinforcement 31, as shown in the exemplary embodiment shown in FIG. 6, has a rectangular cross section that is fifteen and one-half inches wide and fourteen and seven-tenths inches tall, but could be manufactured to larger or smaller dimensions. The Profile 50 of the compression reinforcement 31 may follow a path that starts near the bottom of the composite beam 11 at the ends of composite beam 11 and curves upwards to the highest point on the profile located near the center of the composite beam 11, such that the conduit 38 is tangent to the top flange 33. In the illustrative embodiment shown in FIG. 3, the profile 50 of the compression reinforcement 31 follows a path which starts at approximately seven inches off of the bottom of the composite beam 11 at the ends of composite beam 11 and varies parabolically with the highest point on the profile 50 located at the center of the composite beam 11 such that the conduit 38 is tangent to the top flange 33. The profile 50 of the compression reinforcement 31 may also follow other curved paths that start near the bottom of the composite beam 11 at the ends of composite beam 11 and curve upwards to a point near the center of the composite beam 11.

The profile 50 of the compression reinforcement 31 is designed to resist the compression and shear forces resulting from vertical loads applied to the composite beam 11 in much the same manner as an arch structure. The profile 50 of the compression reinforcement 31 could be constructed along a different geometric path and to different dimensions from those indicated. While an exemplary embodiment of a composite beam 11 of the present disclosure assumes introduction of the compression reinforcement 31 after the beam shell 30 has been erected, it could also be introduced during fabrication of the beam shell 30.

The thrust induced into the compression reinforcement 31 resulting from externally applied loads on the composite beam 11 is equilibrated by the tension reinforcement 32 of the composite beam 11. In one embodiment, the tension reinforcement 32 may comprise layers of unidirectional carbon reinforcing fibers with tensile strength of 160,000 pounds per square inch and an elastic modulus of 16,000,000 pounds per square inch. Although in an exemplary embodiment of the composite beam 11 utilizes carbon fibers, other fibers could also be used for the tension reinforcement 32 including glass, aramid, standard mild reinforcing steel or prestressing strand as is known in the art.

The fibers that are located just above the glass reinforcing of the bottom flange 34 and along the insides of the bottom six inches of the shear transfer medium 35 as illustrated in FIG. 4, may be oriented along the longitudinal axis of the composite beam 11. The fibers may also wrap around the compression reinforcement 31 at the ends of the composite beams 11. The tension reinforcement 32 can be fabricated monolithically into the composite beam 11 at the same time the beam shell 30 is constructed, but could also be installed by encasing conduits in the beam shell 30 which would allow installation at a later date, or by bonding the tension reinforcement 32 to the outside of the beam shell 30 after fabrication. Again, the quantity, composition, orientation and positioning of the fibers in the tension reinforcement 32 can be varied.

In at least one embodiment, all of the composite beams 11 within a span have the same physical geometry, composition and orientation. Benefits could also be obtained using composite beams 11 with different and or varying geometries. Use of composite beams 11 having the same physical geometry for the beam shell 30, however, may minimize tooling costs for fabrication due to economies of scale associated with repetition. Where several bridges 10 are to be built, it may be possible to satisfy the load requirements of different bridges using, composite beams 11 with the same geometry for the beam shell 30, by merely changing the dimensions or profile of the compression reinforcement 31 or the quantity and dimensions of the tension reinforcement 32.

Figure 8:
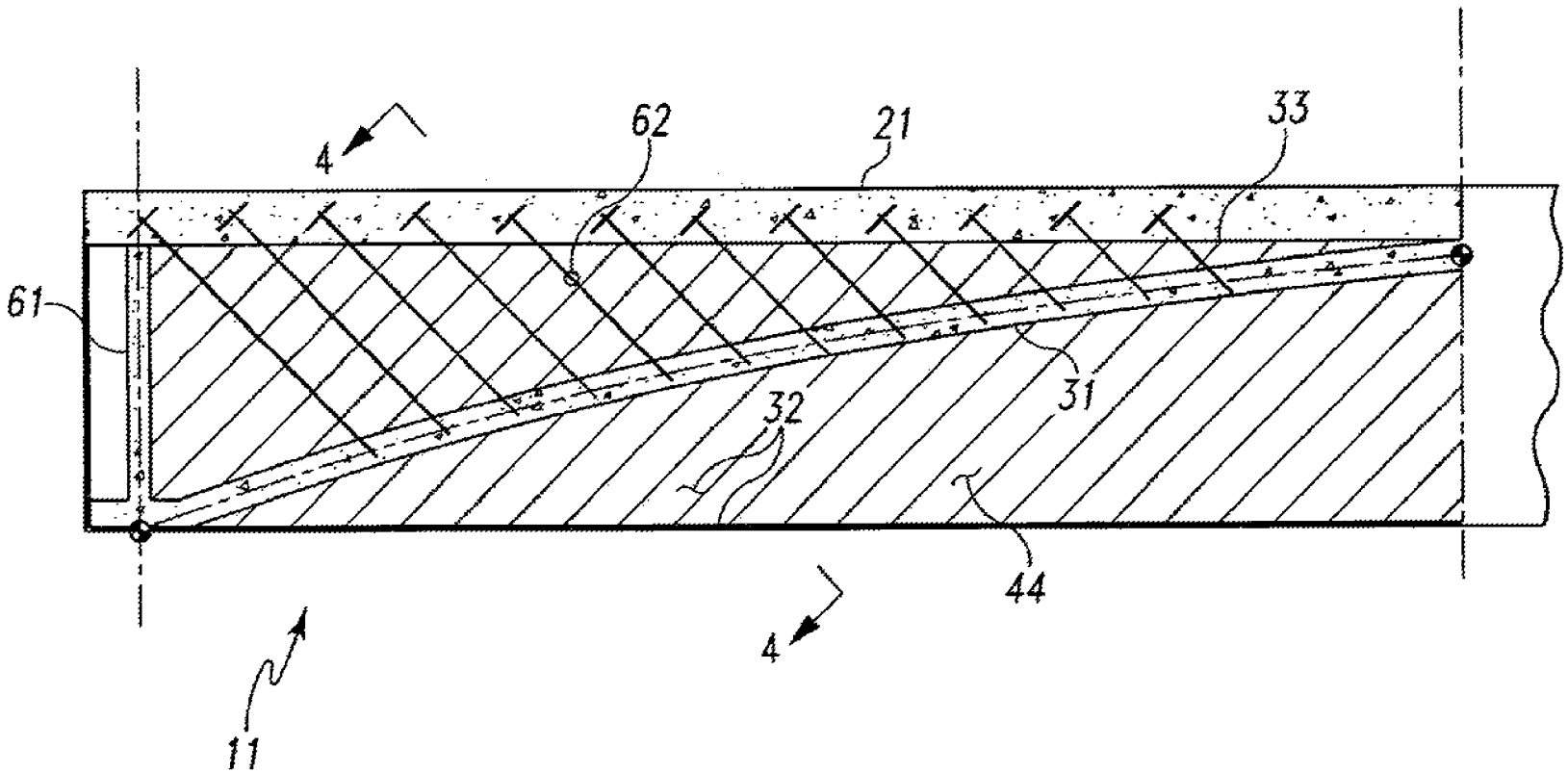
FIG. 8 shows a side view of a second embodiment of the composite beam of the bridge shown in FIG. 1, according to the present disclosure.
Figure 9:
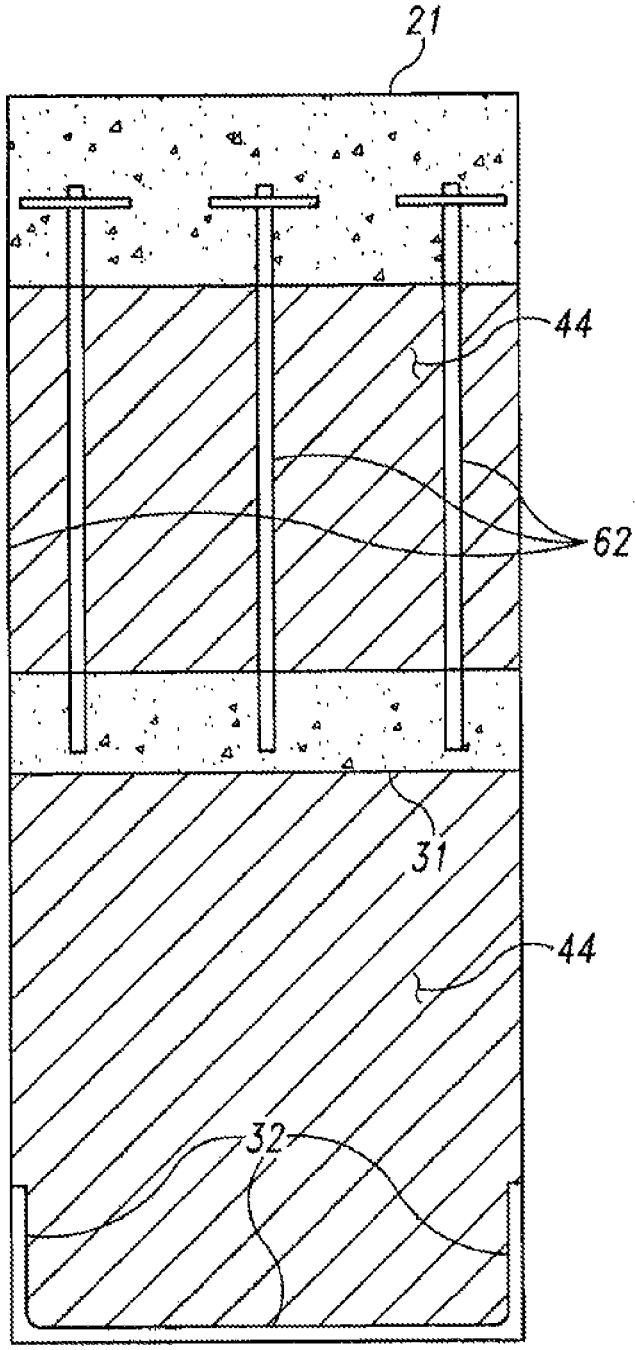
FIG. 9 shows a partial sectional view taken through line 4-4 of FIG. 8, according to the present disclosure.
Figure 10:
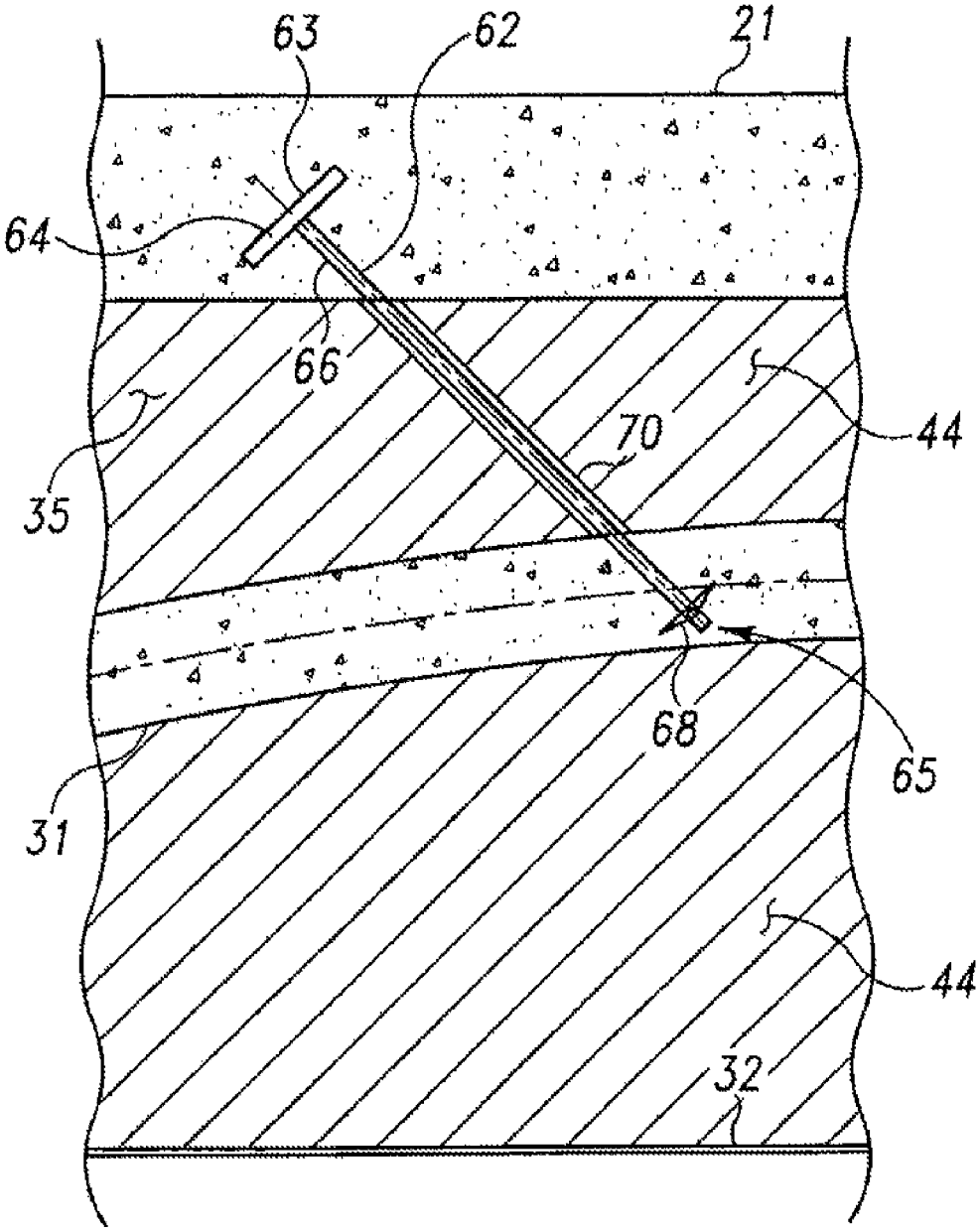
FIG. 10 shows a side view of a first embodiment of a shear connection device of the beam of FIG. 8, according to the present disclosure.
Figure 11:
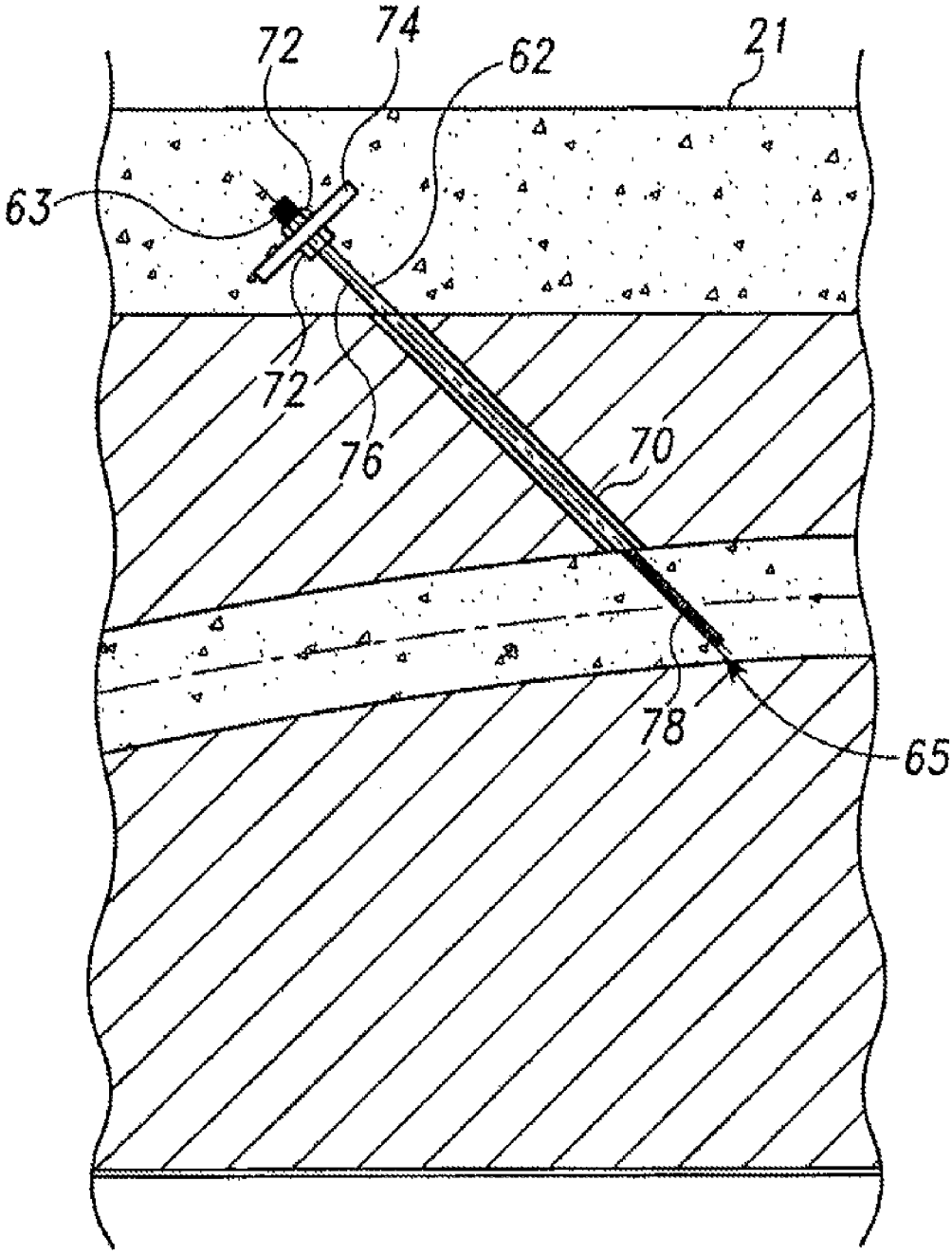
FIG. 11 shows a side view of a second embodiment of a shear connection device of the beam of FIG. 8, according to the present disclosure.
Figure 12:
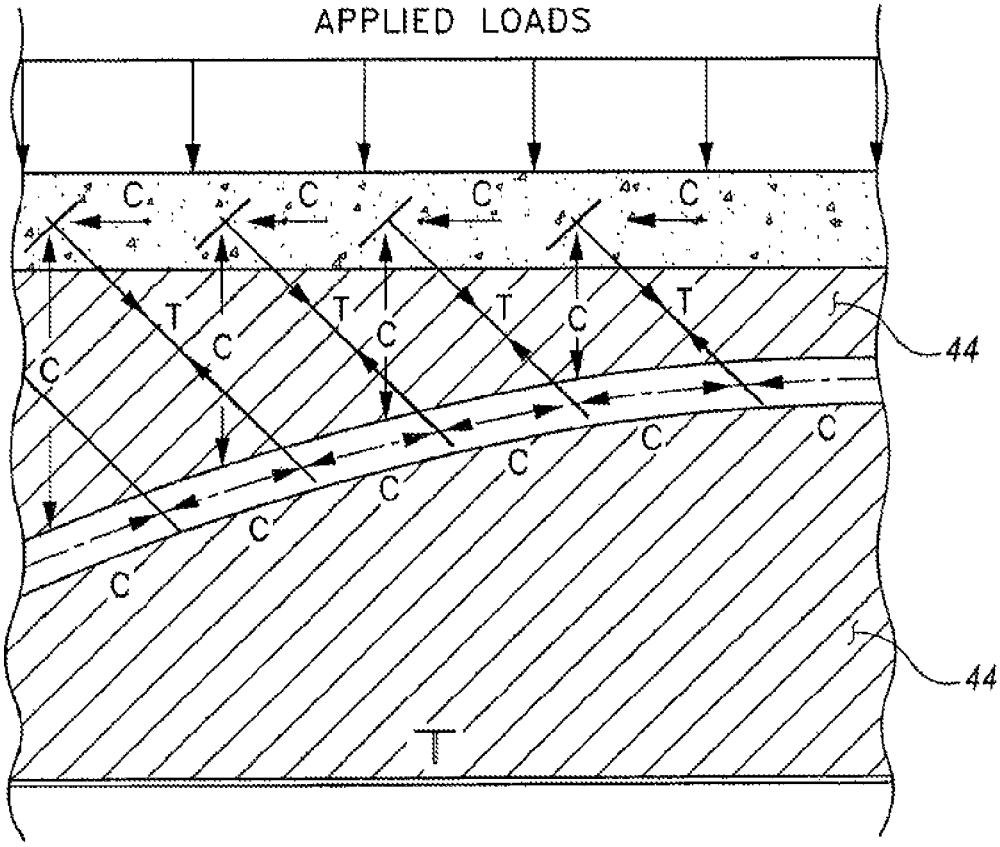
FIG. 12 shows a loading diagram for a section of the beam of FIG. 8, according to the present disclosure.

An embodiment of the composite beam 11 including a shear connection device 62 is shown in FIGS. 8-12. FIG. 8 shows an elevation view of the composite beam 11 including the shear connection device 62. FIG. 9 shows a cross section view of the composite beam 11 including the shear connection device 62 taken through line 4-4 of FIG. 8. FIG. 10 shows a detailed view of an exemplary embodiment of the shear connection device 62. FIG. 11 shows a detailed view of a second exemplary embodiment of the shear connection device 62. FIG. 12 shows a loading diagram showing forces in the composite beam 11, the shear connection devices 62, and the deck slab 21 resulting from an applied load. For clarity, the optional vertical stiffeners 36 are omitted from FIGS. 8-12, so that the shear connection devices 62 may be shown more clearly. It should be understood that the vertical stiffeners 36, as well as various other components of an exemplary composite beam 11 of the present disclosure, may or may not be included in the embodiment of the composite beam 11 described in FIGS. 8-12.

As shown in FIGS. 8 and 9, the composite beam 11 may comprise at least one shear connection device 62. FIGS. 8 and 9 also an exemplary embodiment of illustrative positioning for a plurality of the shear connection devices 62 relative to a composite beam 11. The shear connection device 62 employed between the composite beam 11 and the deck slab 21 may provide two distinct advantages. First, the shear connection device 62 may provide a positive means of connection between the composite beam 11 and the deck slab 21, and thereby preventing any slippage or displacement of the deck slab 21 relative to the composite beam 11. Second, the shear connection device 62 may resist the horizontal shear forces between the top flange 33 of the composite beam 11 and the deck slab 21, thereby allowing the two to act together as a single composite structural component to resist applied loads. Thus, the shear connection device 62 may facilitate composite structural behavior between the composite beam 11 and deck slab 21 and/or the overlying wearing pavement 22.

Various methods for installing and anchoring the shear connection device 62 to the composite beam 11 and/or deck slab 21 will now be described. In a first installation method (not shown), the shear connection device 62 may be attached to the top flange 33 of the composite beam 11 using a mechanical fastener or an adhesive, or fabricated into the top flange 33. This method results in the transfer of shear forces through the webs of the composite beam 11.

In a second installation method, shown in FIGS. 8-11, the shear connection devices 62 may be installed through holes 70 formed through the top of the shell 30 of the composite beam 11, and through a wall of the conduit 38. In embodiments where the composite beam 11 includes the core material 44, the holes 70 likewise are formed in the core material 44 that fills a portion of the interior volume of the beam shell 30, as shown. The shear connection device 62 may then be anchored into the composite beam 11 by allowing a first end 65 to extend into the profiled conduit 38 prior to the introduction of the compression reinforcement 31 into the profiled conduit 38. Later, for example at the construction site of the bridge 10, the compression reinforcement 31 may be placed and cured, such that the shear connection device 62 will be rigidly attached to the composite beam 11. Alternatively, the compression reinforcement 31 may be placed and cured at a manufacturing site.

A second end 63 of the shear connection device 62 may be allowed to protrude through the top of the composite beam 11. The shear connection device 62 may also contain an anchoring device near the end 63. For example, the anchoring device may be rigidly attached to the shear connection device 62 near the end 63. The anchoring device may comprise a square plate or large washer, as described below and shown in FIGS. 10 and 11. Of course, this anchoring device could take on many other forms as well, and could be round, square, rectangular, star-shaped, octagonal, hexagonal, pentagonal, or have the form of almost any conceivable polygon.

Various embodiments of the shear connection device 62 having many different forms are envisioned and within the scope of the present disclosure and the claims attached to this disclosure. In one embodiment, the shear connection device 62 may comprise a body 76. For example, the body 76 may comprise a threaded rod inserted into the composite beam 11, as shown in FIG. 11. The threads 78 on the rod may provide for the shear interface with the compression reinforcement 31 to develop the tension force in the shear connection device 62. The top portion 63 of the embodiment of the shear connection device 62 shown in FIG. 11 may include an anchoring device comprising a plate 74. For example, the plate 74 having a thickness of between about one-quarter inch and one-half inch thick, with a hole cut through the plate 74, preferably near the center. The plate 74 may be attached to the threaded rod by bolts 72 screwed on to the threaded rod on either side of the plate 74. In other embodiments, the plate 74 could also be welded or cast on to the body 76 of the shear connection device 62. The plate 74 and the body 76 may comprise a metal, such as steel, iron, aluminum, nickel, copper, or a metallic alloy. The plate 74 and the body 76 may also comprise a composite material, such as glass, fiberglass, carbon, steel, or a mixture of these or other materials.

In another embodiment, the shear connection device 62 may comprise a prefabricated fiber reinforced plastic (FRP) member with very similar geometry to the embodiment of the shear connection device 62 described above. There may be benefits to using an FRP shear connector, such as limiting corrosion and degradation over time due to oxidation, as may occur with a metallic construction.

As shown in FIG. 10, an exemplary embodiment of a shear connection device 62 may comprise a body 66 and an end 65 having an expandable appendage 68 that expands as the shear connection device 62 is inserted into the profiled conduit 38, in a similar manner to the operation of a toggle bolt. The appendage 68 shown in FIG. 10 may allow for further development of the shear connection device 62 anchorage into the compression reinforcement 31. The top portion 63 of the embodiment of the shear connection device 62 shown in FIG. 10 may also include an anchoring device comprising a plate 64. For example, the plate 64 may be attached to the body 66 (which may comprise a rod) by bolts, or may be welded or cast on to the body 66 of the shear connection device 62 near the top portion 63. The plate 64 and the body 66 may comprise a metal, such as steel, iron, aluminum, nickel, copper, or a metallic alloy. The plate 64 and the body 66 may also comprise a composite material, such as glass, fiberglass, carbon, steel, FRP, or a mixture of these or other materials.

As shown by the load diagram in FIG. 12, a benefit of the anchoring devices of the shear connection device 62 is a transfer in tension, of the compression forces developed in the deck slab 21 during bending, through the shear connection device 62 to the compression reinforcement 31. In FIG. 12, T represents tension force and C represents compression force. The tension force introduced into the shear connection device 62 and the compression forces in the desk slab 21 are equilibrated by a vertical force that is directed into the core material 44 between the top flange 33 of the composite beam 11 and the compression reinforcement 32.

As shown in FIGS. 8-12, the shear connection device 62 may be installed on an angle of approximately forth-five degrees; however, in various embodiments this angle may be larger or smaller. The intent is to angle the shear connection device 62 in a direction extending towards the point in the composite beam 11 that has zero shear force from applied loads. The efficiency of the shear connection device 62 in equilibrating forces may be dependent on its the angle of inclination.

One feature of the embodiment of the composite beam 11 shown in shown in FIGS. 8-12 may be auxiliary conduits 61 formed in the core material 44 during construction of the composite beam 11. Although described and shown having a vertical orientation in the exemplary embodiment shown in FIG. 8, the auxiliary conduits 61 may be oriented in any direction. The auxiliary conduits 61 can later be filled with a material similar to that used for the compression reinforcement 31, similarly to the manner by which the profiled conduit 38 is filled. Once filled, these auxiliary conduits 61 can serve various distinct purposes. In the exemplary embodiment shown in FIG. 8, one or more cylindrical auxiliary conduits 61 are oriented in a vertical position at the centerlines of bearing of the composite beam 11. (Because only half of the composite beam 11 is shown in FIG. 8, only one centerline of bearing is shown, and only half of the cylindrical auxiliary conduits 61 are shown.) In this exemplary embodiment, once the auxiliary conduits 61 are filled with a compression reinforcement 31, they serve as bearing stiffeners at the ends of the composite beam 11. In another example, similar auxiliary conduits 61 could also be introduced at other discreet locations along the composite beam 11. For example, auxiliary conduits 61 could also be introduced directly under the anchoring devices of the shear connection device 62. Additionally, the auxiliary conduits 61 can also be filled with a compression reinforcement 31 and serve as a load path to transfer the auxiliary component of bearing stress in lieu of the shear transfer medium 35, or the core material 44.

Additionally, the auxiliary conduits 61 may serve as a location to attach an injection hose or tube to facilitate pumping the compression reinforcement material into the interior volume of the composite beam 11. By using the auxiliary conduits 61 for this purpose, it may possible to inject the compression reinforcement 31 into a composite beam 11 from the lowest point on the profiled conduit 38, while providing a vent at the highest point on the profiled conduit 38, in order to help ensure that no air is trapped in the compression reinforcement 31. The auxiliary conduits 61 may also serve as a location to insert a threaded rod or a lifting hook, which can provide a means for lilting the composite beam 11 for erection during construction of the bridge 10.

Fabrication of these auxiliary conduits 61 into the composite beam 11 may be accomplished as follows. Prior to infusion of a composite beam 11 with the compression reinforcement 31, the auxiliary conduits 61 may be created by removing a volume of the shear transfer medium 35 from the desired location by cutting or drilling the core material 44. A bagging material or a flexible bladder, which may be fabricated from latex, can be placed in the space created in the core material 44. A hole may also be provided in the composite beam 11 mold, such that the bagging material or bladder can extend through the hole and remain impermeable on the inside of the mold, but open to the atmosphere on the outside of the mold. As such, said bladder would remain open to atmospheric pressure during infusion of the composite beam 11 during the introduction of the resin into the composite beam 11. Vacuum pressure may be applied to the mold that will expand and compress the bagging material or bladder against the core material 44 inside the composite beam 11, thereby preventing the resin from filling this interior volume during infusion of the composite beam 11. Subsequent to the infusion of the composite beam 11 with the resin, the bagging material or bladder can simply be removed resulting in the desired conduit. The general process for creating a composite structure using a resin are known to those of skill in the art.

Figure 13A:
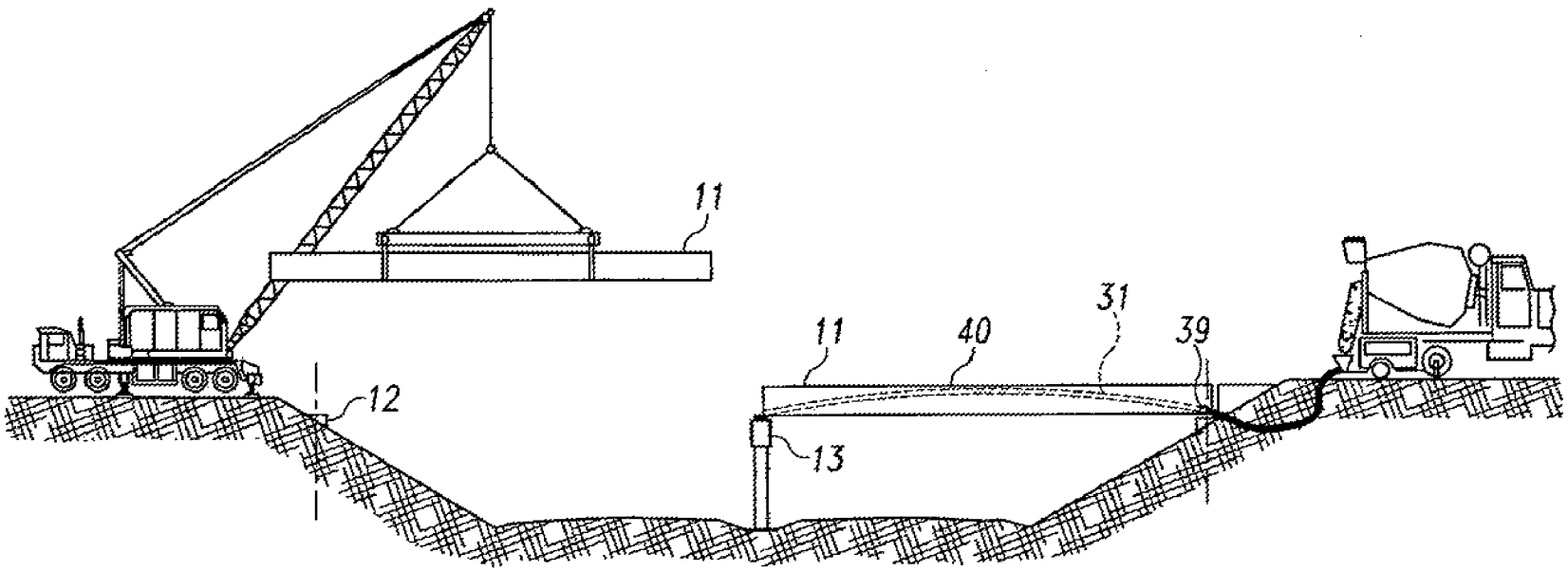
FIG. 13A shows a diagrammatic view showing composite beams being placed on the substructure for the bridge shown in FIG. 1, according to the present disclosure.

An illustrative bridge 10 can be built quickly and easily, as shown in FIG. 13A. The composite beams 11 may be erected prior to injection of the compression reinforcement 31 by placing them with a crane, as is standard in the art. The composite beams 11 can be self supporting prior to and during the installation of the compression reinforcement 31. In the case of bridge replacement or rehabilitation, it may be possible to reuse existing abutments and/or intermediate piers. The compression reinforcement 31 may then be introduced into the composite beam 11 by, for example, injecting a compression reinforcement material into the profiled conduit 38 in the beam shell 30. The compression reinforcement 31 may be injected using pumping techniques, which are known in the art.

Once the composite beams 11 are in place and the compression reinforcement 31 has been introduced, the deck slab 21 may cast in place on the tops of the composite beams 11. In one embodiment, the deck slab 21 is a seven-inch thick reinforced concrete slab. The deck slab 21 can also be constructed using different composition and/or different materials.

Figure 13B:
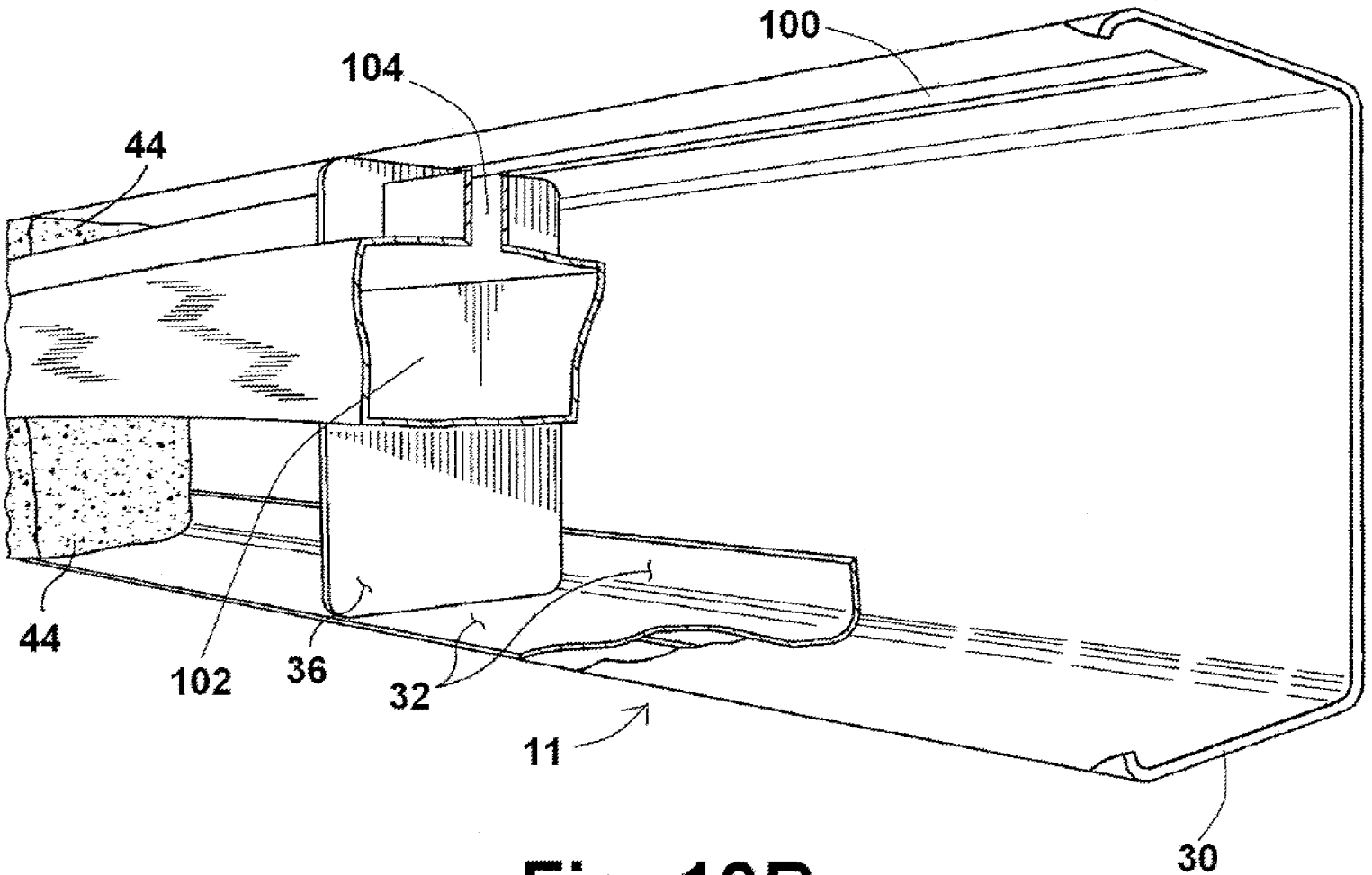
FIG. 13B shows a fragmentary perspective of a composite beam, according to the present disclosure.

An additional exemplary embodiment of a composite beam 11 of the disclosure of the present application is shown in FIG. 13B. As shown in FIG. 13B, composite beam 11 comprises an elongated beam shell 30 having a length and an interior volume, further defining a first aperture 100. Composite beam 11, in this exemplary embodiment, may further comprise a first conduit 102 within the interior volume of the elongated beam shell 30, wherein the first conduit 102 has a curved profile (as shown in FIG. 15A) extending along a longitudinal direction of the composite beam 11. Composite beam 11 may further comprise a second conduit 104 within the interior volume of the elongated beam shell 30, the second conduit 104 extending along at least a portion of the length of the elongated beam shell 30, wherein the first conduit 102 and the second conduit 104 are in communication with one another. An exemplary composite beam 11, as shown in FIGS. 14A-14C, may also comprise a first flange 106 positioned upon the elongated beam shell 30 relative to the first aperture 100.

Figure 14C:
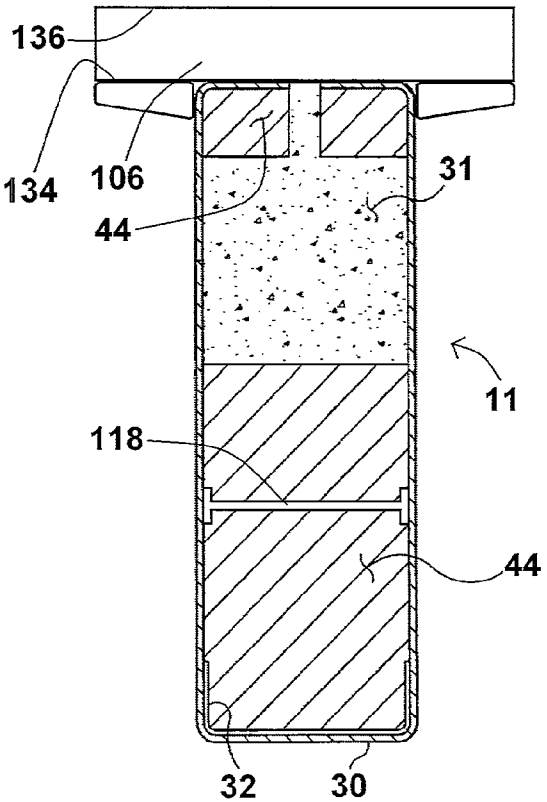
FIGS. 14A-14C show partial sectional views of various embodiments of a composite beam, according to the present disclosure.
Figure 14B:
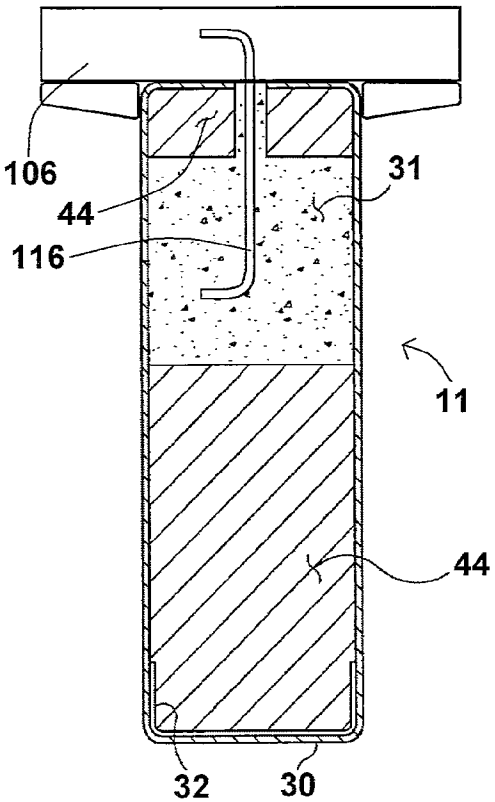
Figure 15A:
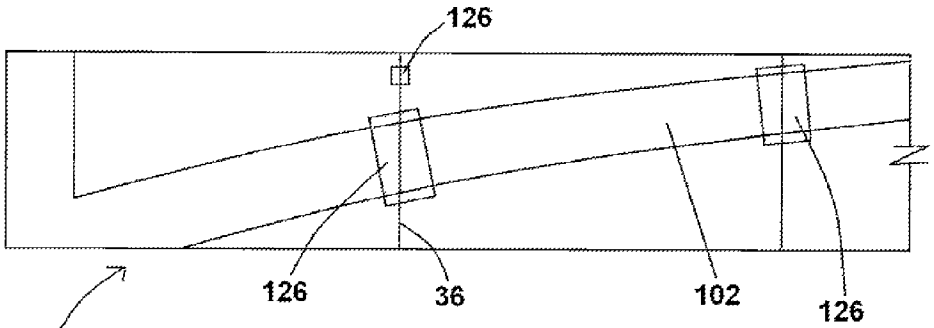
FIG. 15A shows a side view of an exemplary embodiment of a composite beam, according to the present disclosure.

In at least one embodiment, the first conduit 102 and the second conduit 104 of the composite beam 11 are sized and shaped to receive a compression reinforcement 31 as shown in FIGS. 14B and 14C. As shown in the exemplary embodiment of a composite beam 11 shown in FIGS. 14B and 14C, the composite beam 11 comprises a compression reinforcement 31 positioned within at least part of the first conduit 102 and at least part of the second conduit 104, whereby the compression reinforcement 31 contributes to the strength of the composite beam 11. An exemplary compression reinforcement 31 of the present disclosure may comprise standard concrete, portland cement concrete, portland cement grout, polymer cement concrete, polymer concrete, or a mixture or one or more of these exemplary compression reinforcement 31 materials.

Figure 14A:
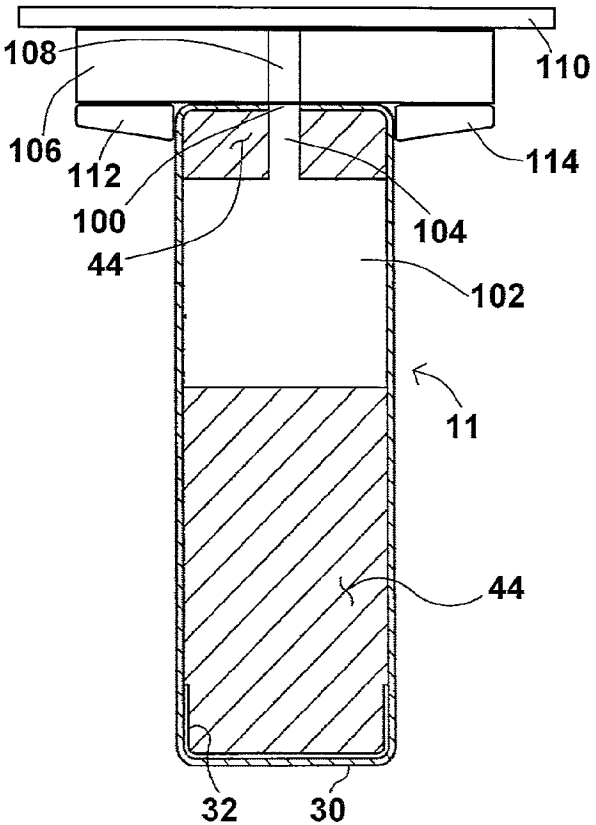

As shown in the exemplary embodiment of a composite beam 11 shown in FIG. 14A, the first flange 106 comprises a flange conduit 108 that is in communication with the second conduit 104 via first aperture 100. In various embodiments, the first flange 106 does not comprise a flange conduit 108. In at least one embodiment, and as shown in FIG. 14A, the first flange 106 is configured to support a structure 110 positioned thereon. Structure 110 may comprise any number of construction materials, including, but not limited to, wood, metal, plastic, pavement material, and/or concrete.

In at least one embodiment of a composite beam 11 of the present disclosure, and as shown in FIG. 14A, composite beam 11 further comprises a second flange 112 positioned relative to the first flange 106 and the elongated beam shell 30, the second flange 112 sized and shaped to engage at least a portion of the elongated beam shell 30. An exemplary composite beam 11 may further comprising a third flange 114 positioned relative to the first flange 106 and the elongated beam shell 30, the third flange 114 sized and shaped to engage at least a portion of the elongated beam shell 30. First flange 112 and/or second flange 114 may provide additional structural support to composite beam 11, including additional structural integrity when, for example, a structure 110 is positioned thereon.

In at least one embodiment of a composite beam 11 of the present disclosure, and as shown in FIG. 14B, the composite beam may further comprise a shear bracket 116, wherein a first portion of the shear bracket 116 is positioned within the first conduit 102, and wherein a second portion of the shear bracket 116 is positioned within the second conduit 104. In at least one embodiment, the first portion of the shear bracket 116 is fixedly coupled within a compression reinforcement 31 positioned within the first conduit 102. In another embodiment, and as shown in FIG. 14B, the second portion of the shear bracket 116 is fixedly coupled to the first flange 106. An exemplary shear bracket 116 may comprise fiber reinforced plastic or any other suitable material for composite beam 11 construction as referenced herein. In at least one embodiment of a composite beam 11 of the present disclosure, a shear bracket 116 may be used as a shear connection device 62, and vice versa. For example, and in an exemplary embodiment, a construction beam 11 may comprise a shear connection device, wherein a first portion of the shear connection device is positioned within the first conduit, and wherein a second portion of the shear connection device is positioned within the second conduit.

In an exemplary embodiment of a composite beam 11 of the disclosure of the present application, and as shown in FIGS. 13B and 14A-14C, the composite beam 11 may further comprise a first core material 44 positioned within the interior volume of the elongated beam shell 30, whereby the first core material 44 is external to the first conduit 102 and the second conduit 104. The first core material 44 may comprise any number of suitable materials, including, but not limited to, general low density foam, polyisocyanorate, polyurethane, polystyrene, starch, wood, synthetic starch, processed starch, and/or various types of fibrous material.

Figure 15B:
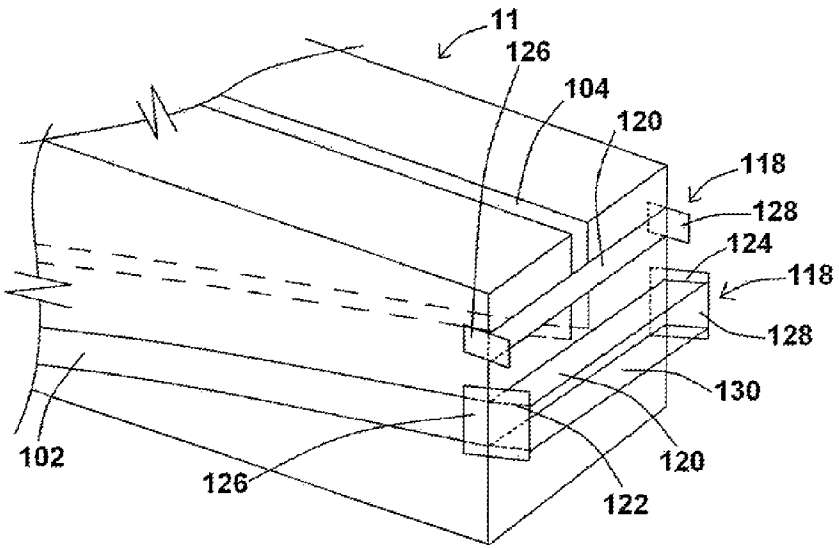
FIGS. 15B and 16 show a perspective views of an exemplary embodiments of a composite beam, according to the present disclosure.

In at least one embodiment of a composite beam 11 of the present application, and as shown in FIGS. 14C and 15B, the composite beam 11 further comprises at least one constraining member 118, the at least one constraining member 118 positioned within the elongated beam shell 30 external to the first conduit 102. The at least one constraining member 118, as shown in FIGS. 14C and 15B, is operable to prohibit substantial deflection of the diameter/perimeter of the elongated beam shell 30. In an exemplary embodiment, at least part of the at least one constraining member 118 is positioned within the elongated beam shell 30 external to the first conduit 102, and at least part of the at least one constraining member 118 is positioned external to the elongated beam shell 30, wherein the at least one constraining member 118 prohibits substantial deflection of the diameter/perimeter and/or the perimeter of the elongated beam shell 30.

In an exemplary embodiment of a composite beam 11, the first aperture 100 of the elongated beam shell 30 extends at least a portion of the length of the elongated beam shell 30. In various embodiments, the first aperture 100 of the elongated beam shell 30 is in communication with the second conduit 104.

In an exemplary embodiment of a composite beam 11 of the disclosure of the present application, and as shown in FIGS. 13B and 15A, the composite beam 11 further comprises at least one intermediate vertical stiffener 36 positioned within the interior volume of the elongated beam shell 30, the at least one intermediate vertical stiffener 36 contributing to the strength of the composite beam 11. In an additional embodiment, and as shown in FIGS. 13B and 14A-14C, a exemplary composite beam 11 of the present disclosure may further comprise at least tension reinforcement 32 positioned within the interior volume of the elongated beam shell 30, the at least one tension reinforcement 32 extending at least a portion of the length of the elongated beam shell 30 and contributing to the strength of the composite beam 11.

Exemplary composite beams 11 of the present disclosure may have a number of other features and/or characteristics. For example, the first conduit 102 may follow a generally parabolic path. Furthermore, the elongated beam shell 30 may resistant to corrosion by chloride ions, and may, in at least one embodiment, comprise plastic.

In at least one embodiment of a composite beam 11 of the present disclosure, the composite beam 11 comprises an elongated beam shell 30 having a length, a diameter/perimeter, and an interior volume, a first conduit 102 within the interior volume of the elongated beam shell 30, the first conduit 102 having a curved profile extending along a longitudinal direction of the composite beam 11, a second conduit 104 within the interior volume of the elongated beam shell 30, the second conduit 104 extending along at least a portion of the length of the elongated beam shell 30, wherein the first conduit 102 and the second conduit 104 are in communication with one another. The composite beam 11, in at least one exemplary embodiment and as shown in FIGS. 14C and 15B, may further comprise at least one constraining member 118, the of least one constraining member 118 external to the first conduit within the elongated beam shell 30, wherein the at least one constraining member 118 prohibits substantial deflection of the diameter/perimeter of the elongated beam shell 30. In an additional embodiment, the composite beam 11 further comprises a compression reinforcement 31 positioned within at least part of the first conduit 102 and at least part of the second conduit 104, wherein the compression reinforcement 31 contributes to the strength of the composite beam 11.

In at least one embodiment of a composite beam 11 of the disclosure of the present application that comprises at least one constraining member 118 as shown in FIG. 15B, the at least one constraining member 118 comprises a first lateral member 120 having a first end 122 and a second end 124, a first end member 126 coupled to the first lateral member 120 at the first end 122 of the first lateral member 120, and a second end member 128 coupled to the first lateral member 120 at the second end 124 of the first lateral member 120. In another embodiment, the at least one constraining member 118 further comprises a second lateral member 130 positioned relative to the first lateral member 120, wherein the second lateral member 130 is coupled at one end to the first end member 126 and at another end to the second end member 128. In at least one embodiment, a first lateral member 120 of an exemplary constraining member 118 may be approximately 24" in length, and a first end member 126 may be approximately 4" high and 3" deep. In an exemplary embodiment of a constraining member 118 having a first lateral member 120 and a second lateral member 130, the first lateral member 118 and the second lateral member 130 may be approximately 24" in length, and the first end member 126 may be approximately 9" high and 6" deep.

In at least one embodiment of a construction system of the disclosure of the present application, the system comprises a composite beam 11 of the disclosure of the present application comprising an elongated beam shell 30, a first conduit 102, and a second conduit 104, each as described or referenced herein, and further comprises a first flange 106 comprising a first side 134 and a second side 136, the first side 134 positioned relative to the elongated beam shell 30 of the composite beam 11.

Figure 16:
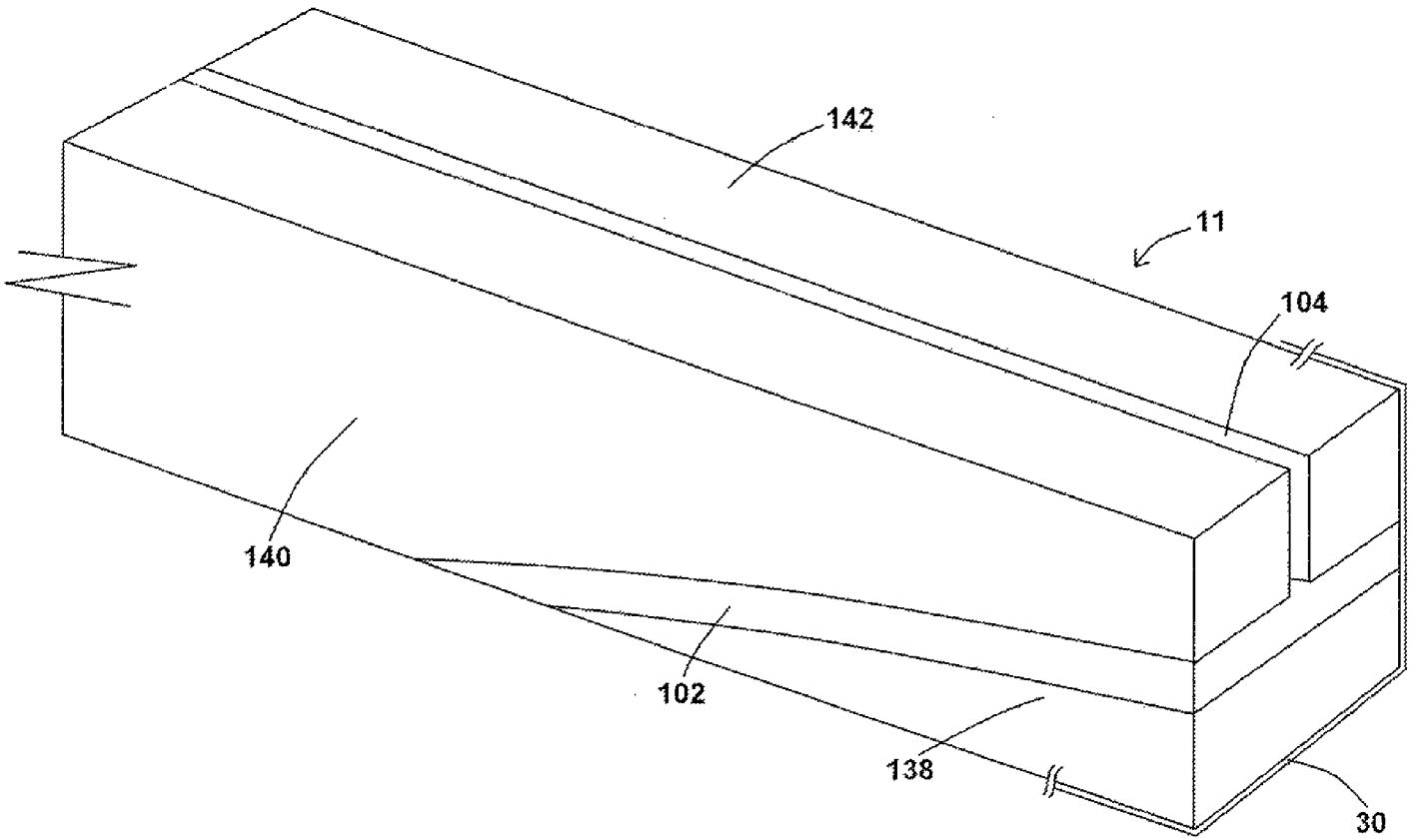

In an exemplary embodiment of a composite beam 11 of the present disclosure, and as shown in FIG. 16, the composite beam 11 comprises an elongated beam shell 30, a first core material 138 positioned within the elongated beam shell 30, wherein the first core material 138 is tapered at one end, and a second core material 140 positioned within the elongated beam shell 30 relative to the first core material 138, wherein the first core material 138 and the second core material 140 do not engage one another. In an exemplary embodiment, the first core material 138, the second core material 140, and core material 44 comprise the same material. In at least one embodiment, the first core material 138 and second core material 140 define a first conduit 102 extending at least a portion of length of the elongated beam shell 30 and further define a second conduit 104 extending from the first conduit, wherein the first conduit 102 and second conduit 104 are in communication with one another. In an additional embodiment, the composite beam 11 further comprises a third core material 142, wherein the second core material 140 and third core material 142 further define the second conduit 104.

While various embodiments of hybrid composite beams and beam systems and methods of using the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

We claim:

1. A construction beam, the beam comprising:

an elongated shell having a length, a first relative end, and an interior volume, the elongated shell defining a first aperture;

a first conduit within the interior volume of the elongated shell, the first conduit extending along a longitudinal direction of the beam and curving upward from the first relative end;

a second conduit within the interior volume of the elongated shell, the second conduit extending along at least a portion of the length of the elongated shell, wherein the first conduit and the second conduit are in communication with one another; and a first flange positioned upon the elongated shell relative to the first aperture.

2. The construction beam of claim 1, wherein the first conduit and second conduit are sized and shaped to receive a compression reinforcement.

3. The construction beam of claim 1, further comprising a compression reinforcement positioned within at least part of the first conduit and at least part of the second conduit, the compression reinforcement contributing to the strength of the beam.

4. The construction beam of claim 3, wherein the compression reinforcement comprises material selected from the group consisting of concrete, portland cement concrete, portland cement grout, polymer cement concrete, and polymer concrete.

5. The construction beam of claim 1, wherein the first flange comprises a flange conduit in communication with the second conduit.

6. The construction beam of claim 1, further comprising a second flange positioned relative to the first flange and the elongated shell, the second flange sized and shaped to engage at least a portion of the elongated shell.

7. The construction beam of claim 6, further comprising a third flange positioned relative to the first flange and the elongated shell, the third flange sized and shaped to engage at least a portion of the elongated shell.

8. The construction beam of claim 1, further comprising a shear bracket, wherein a first portion of the shear bracket is positioned within the first conduit, and wherein a second portion of the shear bracket is positioned within the second conduit.

9. The construction beam of claim 8, wherein the first portion of the shear bracket is fixedly coupled within a compression reinforcement positioned within the first conduit.

10. The construction beam of claim 8, wherein the second portion of the shear bracket is fixedly coupled to the first flange.

11. The construction beam of claim 8, wherein the shear bracket comprises fiber reinforced plastic.

12. The construction beam of claim 1, further comprising a shear connection device, wherein a first portion of the shear connection device is positioned within the first conduit, and wherein a second portion of the shear connection device is positioned within the second conduit.

13. The construction beam of claim 1, further comprising a first core material positioned within the interior volume of the elongated shell, the first core material external to the first conduit and the second conduit.

14. The construction beam of claim 13, wherein the first core material comprises a material selected from the group consisting of low density foam, polyisocyanorate, polyurethane, polystyrene, starch, wood, synthetic starch, processed starch, and fibrous material.

15. The construction beam of claim 1, further comprising at least one constraining member, the at least one constraining member positioned within the elongated shell external to the first conduit, wherein the at least one constraining member prohibits substantial deflection of the perimeter of the elongated shell.

16. The construction beam of claim 1, further comprising at least one constraining member, wherein at least part of the at least one constraining member is positioned within the elongated shell external to the first conduit and at least part of the at least one constraining member is positioned external to the elongated shell, wherein the at least one constraining member prohibits substantial deflection of the perimeter of the elongated shell.

17. The construction beam of claim 1, wherein the first aperture of the elongated shell extends at least a portion of the length of the elongated shell.

18. The construction beam of claim 1, wherein the first aperture of the elongated shell is in communication with the second conduit.

19. The construction beam of claim 1, further comprising at least one intermediate vertical stiffener positioned within the interior volume of the elongated shell, the at least one intermediate vertical stiffener contributing to the strength of the beam.

20. The construction beam of claim 1, further comprising at least one tension reinforcement positioned within the interior volume of the elongated shell, the at least one tension reinforcement extending at least a portion of the length of the elongated shell and contributing to the strength of the beam.

21. The construction beam of claim 1, wherein the first conduit follows a generally parabolic path.

22. The construction beam of claim 1, wherein the elongated shell is resistant to corrosion by chloride ions.

23. The construction beam of claim 1, wherein the elongated shell comprises plastic.

24. A construction beam, the construction beam comprising:

an elongated shell having a length, a perimeter, a first relative end, and an interior volume;

a first conduit within the interior volume of the elongated shell, the first conduit extending along a longitudinal direction of the beam and curving upward from the first relative end;

an second conduit within the interior volume of the elongated shell, the second conduit extending along at least a portion of the length of the elongated shell, wherein the first conduit and the second conduit are in communication with one another; and at least one constraining member, the at least one constraining member external to the first conduit within the elongated shell, wherein the at least one constraining member prohibits substantial deflection of the perimeter of the elongated shell.

25. The construction beam of claim 24, further comprising a compression reinforcement positioned within at least part of the first conduit and at least part of the second conduit, the compression reinforcement contributing to the strength of the beam.

26. The construction beam of claim 24, wherein the at least one constraining member comprises:

a first lateral member having a first end and a second end;

a first end member coupled to the first lateral member at the first end of the first lateral member; and a second end member coupled to the first lateral member at the second end of the first lateral member.

27. The construction beam of claim 26, wherein the at least one constraining member further comprises a second lateral member positioned relative to the first lateral member, wherein the second lateral member is coupled at one end to the first end member and at another end to the second end member.

28. The construction beam of claim 26, further comprising a core material positioned within the elongated shell, the core material defining at least part of the first conduit, and wherein the at least one constraining member is positioned relative to the core material so as to prohibit substantial deflection of the first conduit.

29. The construction beam of claim 24, further comprising a shear bracket, wherein a first portion of the shear bracket is positioned within the first conduit, and wherein a second portion of the shear bracket is positioned within the second conduit.

30. The construction beam of claim 29, wherein the first portion of the shear bracket is fixedly coupled within a compression reinforcement positioned within the first conduit.

31. The construction beam of claim 24, wherein the first conduit follows a generally parabolic path.

32. The construction beam of claim 24, wherein the first aperture of the elongated shell extends at least a portion of the length of the elongated shell, and wherein the first aperture of the elongated shell is in communication with the second conduit.

33. A construction system, the system comprising:

a beam, the beam comprising:

an elongated shell having a length, a first relative end, and an interior volume, the elongated shell having defining a first aperture;

a first conduit within the interior volume of the elongated shell, the first conduit extending along a longitudinal direction of the beam and curving upward from the first relative end;

a second conduit within the interior volume of the elongated shell, the second conduit extending along at least a portion of the length of the elongated shell, wherein the first conduit and the second conduit are in communication with one another; and a first flange comprising a first side and a second side, the first side positioned relative to the elongated shell of the beam.

34. The construction system of claim 33, wherein the first flange defines at least one aperture in communication with the second conduit.

35. The construction system of claim 33, further comprising a second flange positioned relative to the first flange and the elongated shell, the second flange sized and shaped to engage at least a portion of the elongated shell.

36. The construction system of claim 35, further comprising a third flange positioned relative to the first flange and the elongated shell, the third flange sized and shaped to engage at least a portion of the elongated shell.

37. A construction beam, the beam comprising:

an elongated shell having a length, a first relative end, and an interior volume;

a first core material positioned within the elongated shell, wherein the first core material is tapered at one end; and a second core material positioned within the elongated shell relative to the first core material, wherein the first core material and the second core material do not engage one another;

wherein the first core material and second core material define a first conduit extending at least a portion of length of the elongated shell and curving upward from the first relative end and further define a second conduit extending from the first conduit;

wherein the first conduit and second conduit are in communication with one another.

38. The construction beam of claim 37, further comprising a third core material, wherein the second core material and third core material further define the second conduit.

39. The construction beam of claim 37, further comprising a first flange positioned upon the elongated shell.

40. The construction beam of claim 37, further comprising a compression reinforcement positioned within at least part of the first conduit and at least part of the second conduit, the compression reinforcement contributing to the strength of the beam.

41. The construction beam of claim 37, further comprising a shear bracket, wherein a first portion of the shear bracket is positioned within the first conduit, and wherein a second portion of the shear bracket is positioned within the second conduit.

42. A construction beam, the beam comprising:

an elongated shell having a length, a first relative end, and an interior volume, the elongated shell defining a first aperture extending at least a portion of the length of the elongated shell;

a first conduit within the interior volume of the elongated shell, the first conduit having extending along a longitudinal direction of the beam and curving upward from the first relative end;

a second conduit within the interior volume of the elongated shell, the second conduit extending along at least a portion of the length of the elongated shell, wherein the first conduit and the second conduit are in communication with one another, and wherein the first conduit and second conduit are sized and shaped to receive a compression reinforcement;

a compression reinforcement positioned within at least part of the first conduit and at least part of the second conduit, the compression reinforcement contributing to the strength of the beam;

a first flange positioned upon the elongated shell relative to the first aperture;

a second flange positioned relative to the first flange and the elongated shell, the second flange sized and shaped to engage at least a portion of the elongated shell;

a third flange positioned relative to the first flange and the elongated shell, the third flange sized and shaped to engage at least a portion of the elongated shell;

a shear bracket, wherein a first portion of the shear bracket is positioned within the first conduit, and wherein a second portion of the shear bracket is positioned within the second conduit; and a first core material positioned within the interior volume of the elongated shell, the first core material external to the first conduit and the second conduit.

* * * * *